US006063006A

United States Patent [19]

Chiu

[11] Patent Number: 6,063,006

[45] Date of Patent: May 16, 2000

[54] GRIP EXERCISE DEVICE

[76] Inventor: Ciber Chiu, No. 407, Sec. 3, Luho Rd., Lukang Chen, Changhua Hsien, Taiwan

[21] Appl. No.: 09/268,518

[22] Filed: Mar. 12, 1999

[51] Int. Cl.[7] ..... A63B 23/16

[52] U.S. Cl. ..... 482/49; 482/126; 482/127

[58] Field of Search ..... 482/49, 126, 127, 482/44, 128

[56] References Cited

U.S. PATENT DOCUMENTS 5,222,926 6/1993 Eggen ..... 482/49
5,360,385 11/1994 Wang ..... 482/49
5,529,551 6/1996 Chin ..... 482/49
5,833,580 11/1998 Chiu ..... 482/49

*Primary Examiner*—Stephen R. Crow
*Attorney, Agent, or Firm*—William E. Pelton, Esq.

[57] ABSTRACT

A grip exercise device includes a grip body having a C-shaped head containing an opening transversely defined therein, two handles each extending from each of the two distal ends of the head, a plurality of elongated retaining ribs radially extending inward from the inner wall of the opening, a plurality of receiving recesses defined between two adjacent retaining ribs, and a cylindrical adjusting member detachably received in the opening and having a plurality of axial blades each detachably secured in one of the corresponding receiving recesses.

1 Claim, 6 Drawing Sheets

GRIP EXERCISE DEVICE

CROSS-REFERENCES TO RELATED APPLICATIONS

Not Applicable.

BACKGROUND OF THE INVENTION

1. Field of the Invention

The present invention relates to a grip exercise device.

2. Description of the Related Art

The closest prior art of which the applicant is aware is disclosed in U.S. Pat. No. 5,833,580 to Chiu, filed on Jun. 17, 1997, entitled "Grip Exercise with a Gear-Shaped Adjusting Member".

BRIEF SUMMARY OF THE INVENTION

In accordance with one aspect of the present invention, there is provided a grip exercise device comprising: a grip body including a C-shaped head containing an opening transversely defined therein, two handles each extending from each of the two distal ends of the head, a plurality of elongated retaining ribs radially extending inward from the inner wall of the opening, a plurality of receiving recesses defined between two adjacent retaining ribs; and a cylindrical adjusting member detachably received in the opening and including a plurality of axial blades each detachably secured in one of the corresponding receiving recesses. The adjusting member includes a holding lug extending from one end thereof. At least one of the plurality of axial blades contains a channel longitudinally defined therein.

The grip exercise device further comprises two arcuate extensions each extending inward from each of the two distal ends of the head and each located adjacent to one of the retaining ribs. Each of the two arcuate extensions contains an arcuate recess therein.

Further benefits and advantages of the present invention will become apparent after a careful reading of the detailed description with appropriate reference to the accompanying drawings.

DETAILED DESCRIPTION OF THE INVENTION

Figure 1:
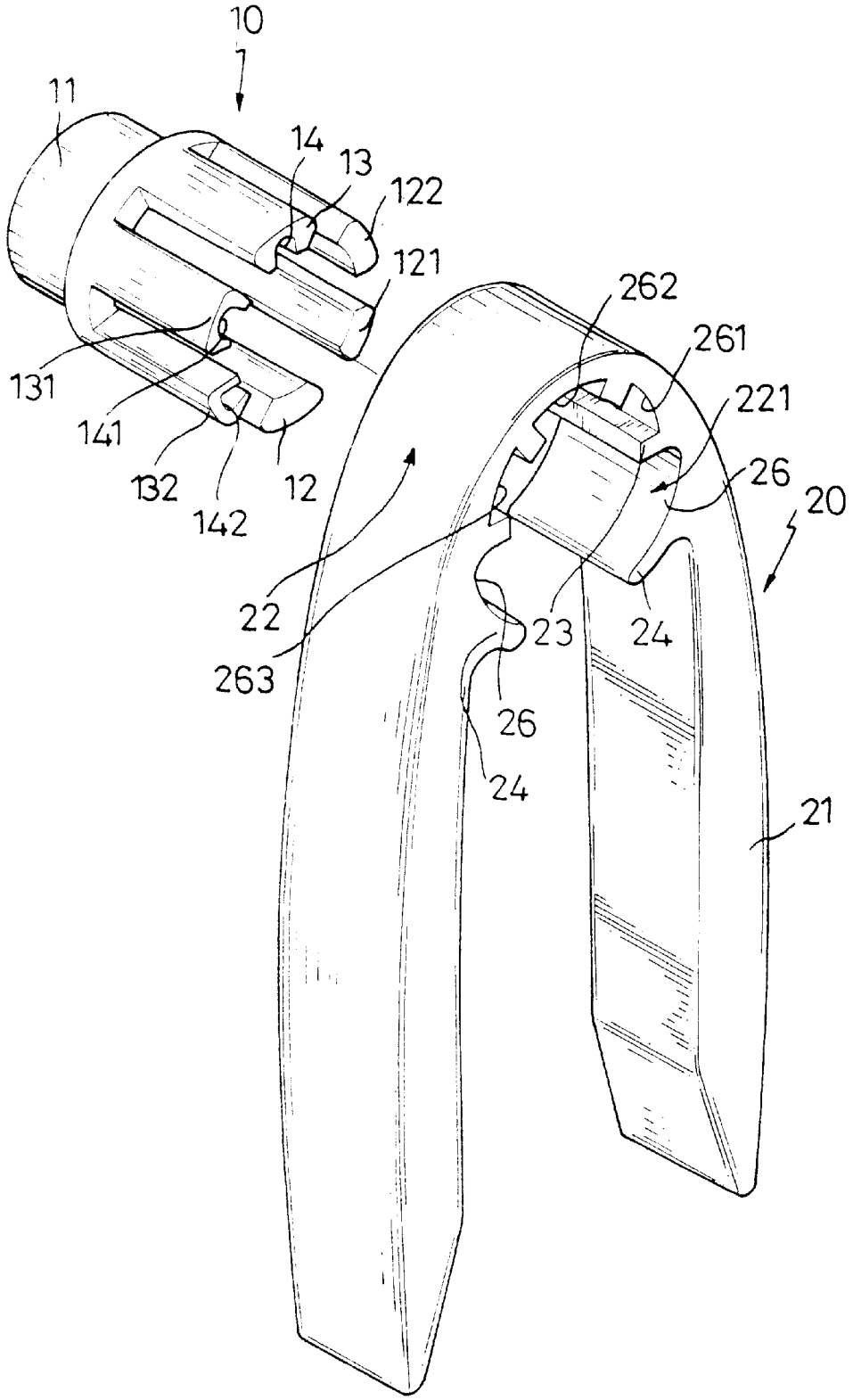
FIG. 1 is an exploded perspective view of a grip exercise device in accordance with a first embodiment of the present invention.
Figure 2:
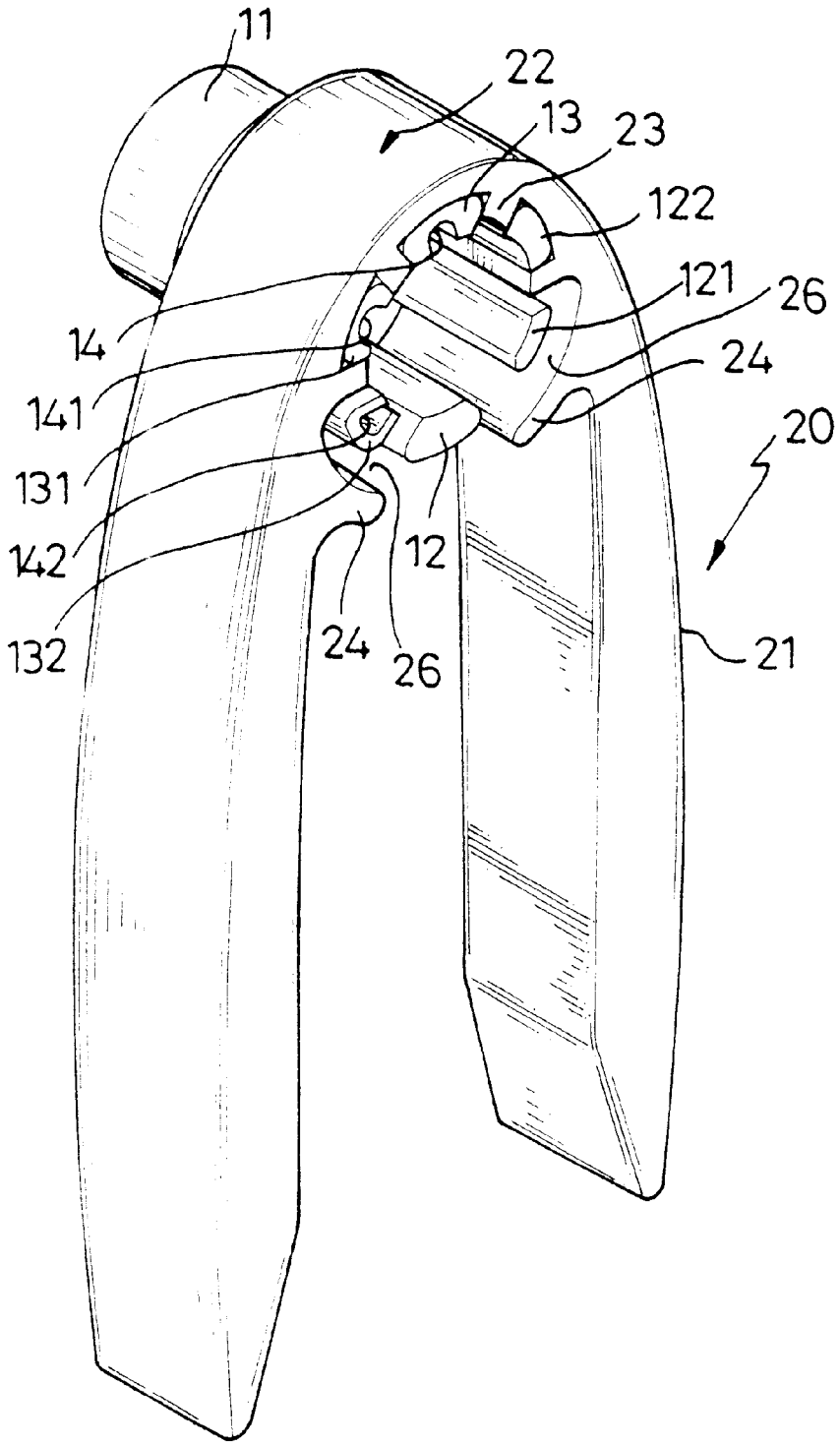
FIG. 2 is an assembly view of the grip exercise device as shown in FIG. 1.
Figure 3:
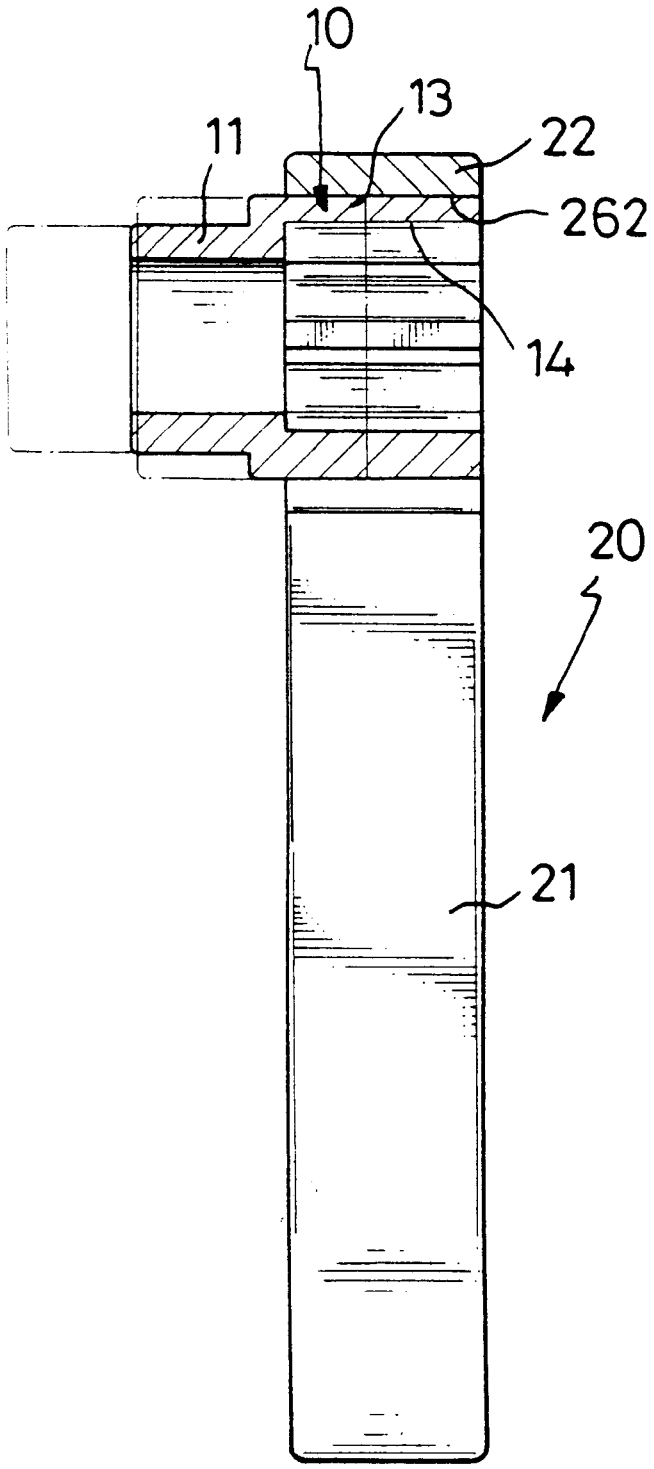
FIG. 3 is a side plan cross-sectional view of the grip exercise device as shown in FIG. 2.

Referring to the drawings and initially to FIGS. 1–3, a grip exercise device in accordance with a first embodiment of the present invention comprises a grip body (20) including a C-shaped head (22) containing an opening (221) transversely defined therein, two handles (21) each extending from each of the two distal ends of the head (22), four elongated retaining ribs (23) radially extending inward from the inner wall of the opening (221), thereby defining three receiving recesses (261; 262; 263), and a cylindrical adjusting member (10) detachably received in the opening (221) and including a holding lug (11) extending from one end thereof, and six equally spaced parallel axial blades (12; 121; 122; 13; 131; 132) any three of which can be detachably secured in one of the three corresponding receiving recesses (261; 262; 263) respectively. Each of the axial blades (12; 121; 122; 13; 131; 132) is the same length.

The grip exercise device further comprises two arcuate extensions (24) each extending inward from each of the two distal ends of the head (22) and each located adjacent to one of the retaining ribs (23). The two arcuate extensions (24) define an arcuate recess (26) to receive three of the axial blades therein such that the extensions are each separated from the outer wall of each of the axial blades when at rest.

The three adjacent axial blades (13; 131; 132) each contain a channel (14; 141; 142) longitudinally defined therein and having a depth different from each other, thereby varying the flexibility of each of the three axial blades (13; 131; 132). The three axial blades (12; 121; 122) have a wall thickness different from each other, thereby in turn varying the grip force of the grip exercise device.

Figure 4:
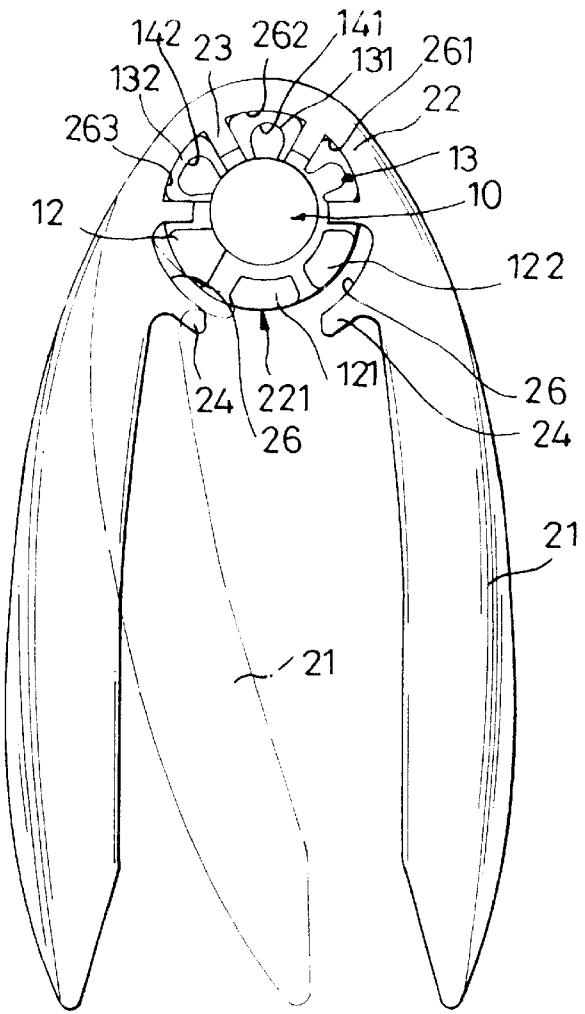
FIG. 4 is a front plan operational view of the grip exercise device as shown in FIG. 2.

In operation, referring to FIG. 4 with reference to FIGS. 1–3, the three axial blades (13; 131; 132) are respectively inserted into the respective receiving recesses (261; 262; 263), with the other three axial blades (12; 121; 122) being received in the space defined by the arcuate recess (26) of each of the two arcuate extensions (24). By such an arrangement, a user can press the two handles (21) to exert a torsional force on the head (22) of the grip body (20) to overcome the resistance provided by the three axial blades (13; 131; 132) of the adjusting member (10) on the retaining ribs (23) of the head (22), thereby achieving the purpose of exercising the hand and forearm. In such a manner, the user can exercise his hand and forearm by means of a smaller resistance provided by the three axial blades (13; 131; 132) due to their flexibility caused by the channels (14; 141; 142).

Figure 5:
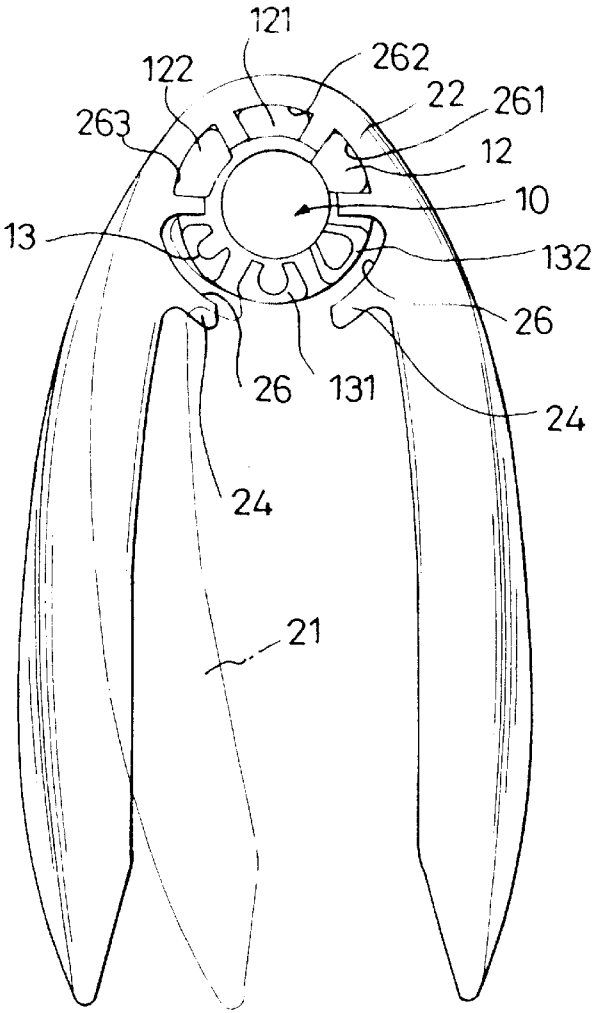
FIG. 5 is a front plan operational view of the grip exercise device as shown in FIG. 2.

Referring now to FIG. 5 with reference to FIGS. 1–3, the three axial blades (12; 121; 122) are respectively inserted into the respective receiving recesses (261; 262; 263), with the other three axial blades (13; 131; 132) being received in the space defined by the arcuate recess (26) of each of the two arcuate extensions (24). By such an arrangement, the user can press the two handles (21) to exert a torsional force on the head (22) of the grip body (20) to overcome the resistance provided by the three axial blades (13; 131; 132) of the adjusting member (10) on the retaining ribs (23) of the head (22), thereby achieving the purpose of exercising the hand and forearm. In such a manner, the user can exercise his hand and forearm by means of a greater resistance provided by the three axial blades (12; 121; 122) due to their solid walls of different wall thickness.

Alternatively, any three of the six equally spaced parallel axial blades (12; 121; 122; 13; 131; 132) can selectively be inserted into the three receiving recesses (261; 262; 263) respectively such that the user can exercise his hand and forearm by means of resistance with different strengths provided by the selected three of the six spaced axial blades(12; 121; 122; 13; 131; 132).

In such a manner, the adjusting member (10) includes a plurality of axial blades each received in the respective receiving recess and each located between the two adjacent retaining ribs such that the deformation of the adjusting member (10) exerted by the retaining ribs is evenly distributed to each of the axial blades, thereby preventing the adjusting member (10) from being deformed excessively. In addition, the hold lug (11) provided on one end of the adjusting member (10) facilitates pulling the adjusting member (10) from the grip body (20).

Figure 6:
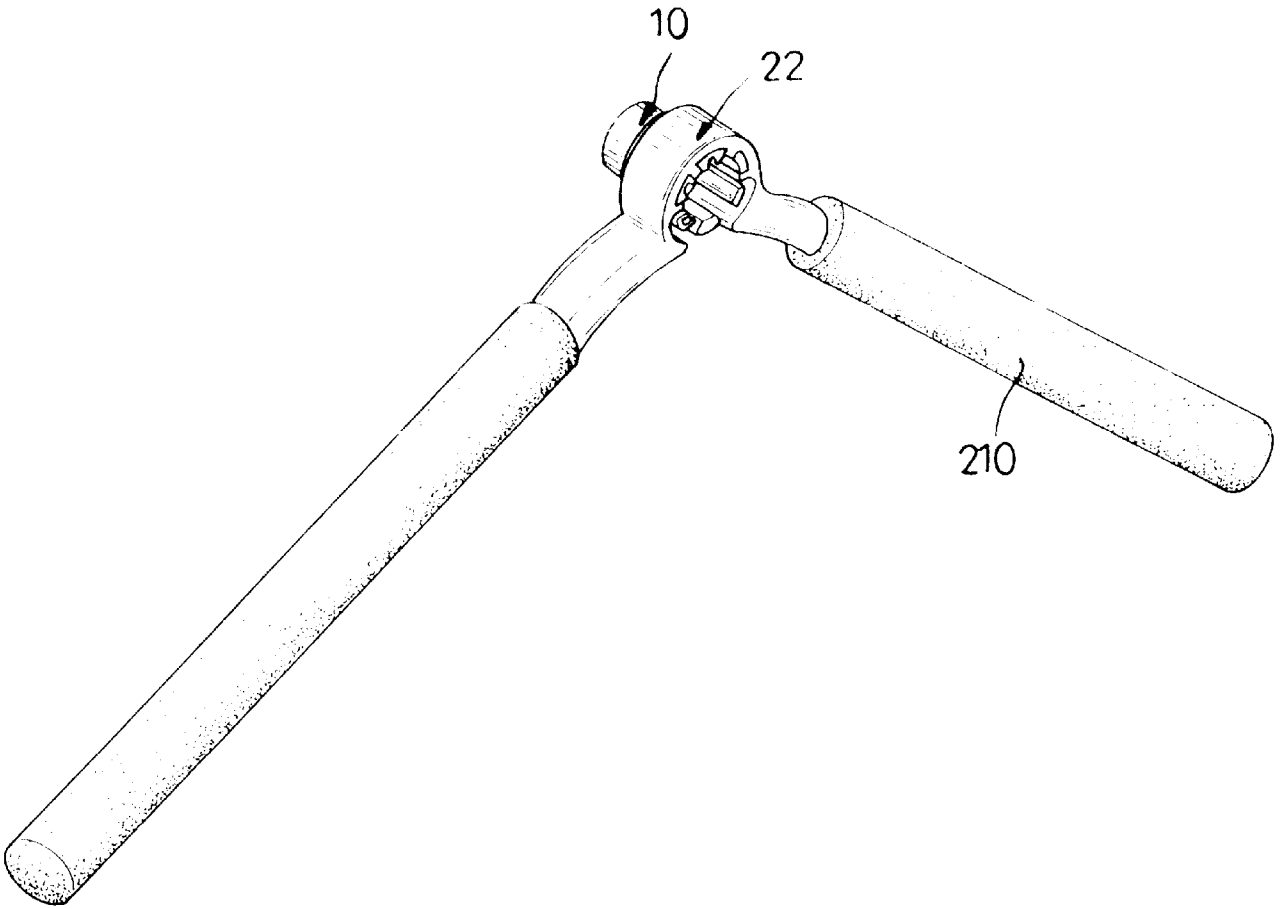
FIG. 6 is a perspective view of the grip exercise device in accordance with a second embodiment of the present invention.

Referring to FIG. 6, in accordance with a second embodiment of the present invention, the grip exercise device is provided with two handles (210) of a different configuration.

Figure 7:
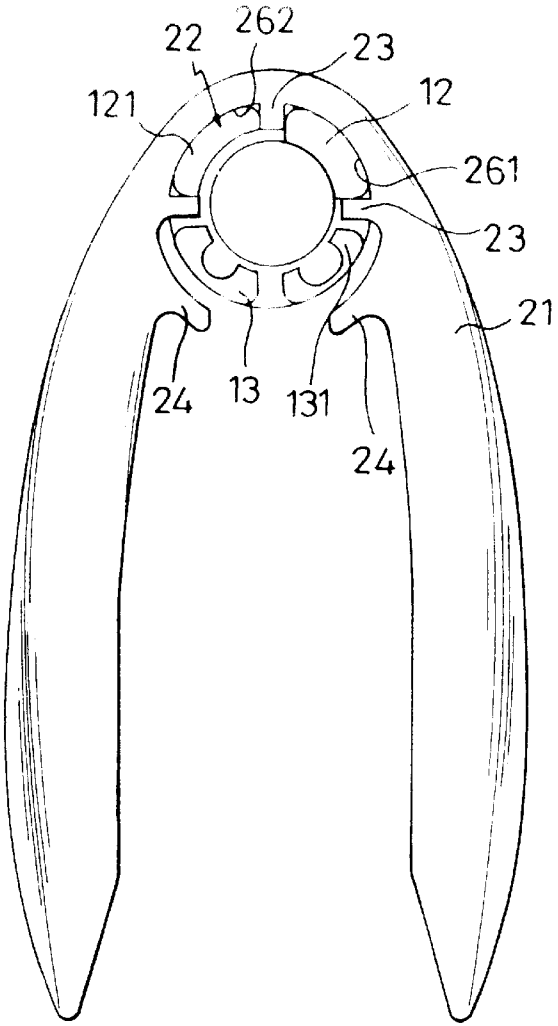
FIG. 7 is a front plan view of the grip exercise device in accordance with a third embodiment of the present invention.

Referring to FIG. 7, in accordance with a third embodiment of the present invention, the head (22) of the grip body (20) includes three elongated retaining ribs (23), thereby defining two receiving recesses (261; 262), and the cylindrical adjusting member (10) includes four equally spaced parallel axial blades (12; 121; 13; 131).

It should be clear to those skilled in the art that further embodiments may be made without departing from the scope and spirit of the present invention.

What is claimed is:

1. A grip exercise device comprising:

a grip body including a C-shaped head containing an opening transversely defined therein, two handles each extending from said head, a plurality of elongated retaining ribs radially extending inward from the inner wall of said opening, a plurality of receiving recesses defined between adjacent retaining ribs, and two arcuate extensions each projecting radially inward from each of the two distal ends of said head each located adjacent to one of said retaining ribs, each of said two arcuate extensions containing an arcuate recess therein; and a cylindrical adjusting member detachably received in said opening and including a plurality of axial blades each detachably secured in one of said corresponding receiving recesses, said adjusting member including a holding lug extending from one end thereof, each of said plurality of axial blades having the same axial length, at least one of said plurality of axial blades containing a channel longitudinally defined therein.

* * * * *